US008808803B2

(12) United States Patent
Zimmerman

(10) Patent No.: US 8,808,803 B2
(45) Date of Patent: Aug. 19, 2014

(54) COATING METHOD FOR REACTIVE METAL

(71) Applicant: Benjamin Joseph Zimmerman, Enfield, CT (US)

(72) Inventor: Benjamin Joseph Zimmerman, Enfield, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 13/735,329

(22) Filed: Jan. 7, 2013

(65) Prior Publication Data

US 2013/0118643 A1 May 16, 2013

Related U.S. Application Data

(63) Continuation of application No. 12/940,171, filed on Nov. 5, 2010, now Pat. No. 8,367,160.

(51) Int. Cl.
*B05D 3/02* (2006.01)

(52) U.S. Cl.
USPC ..... 427/372.2; 427/383.1; 427/383.3; 427/383.7; 427/404; 427/405

(58) Field of Classification Search
None
See application file for complete search history.

(56) References Cited

U.S. PATENT DOCUMENTS 154,435 A 10/1872 Adams
3,542,583 A 11/1970 Small
4,123,594 A 10/1978 Chang
4,261,742 A 4/1981 Coupland et al.
4,261,743 A 4/1981 Coupland et al.
4,321,311 A * 3/1982 Strangman ..... 428/623
4,451,431 A 5/1984 Naik
4,585,481 A * 4/1986 Gupta et al. ..... 106/14.05
4,810,334 A 3/1989 Honey et al.
4,933,239 A 6/1990 Olson et al.
5,401,307 A 3/1995 Czech et al.
5,482,578 A 1/1996 Rose et al.
5,483,578 A 1/1996 Rose et al.
5,500,252 A 3/1996 Meelu
5,650,235 A 7/1997 McMordie et al.
5,688,607 A 11/1997 Rose et al.
5,833,829 A 11/1998 Foster
5,989,733 A 11/1999 Warnes et al.
6,127,047 A 10/2000 Warrell et al.
6,180,259 B1 1/2001 Harada et al.
6,183,888 B1 2/2001 Alperine et al.
6,218,029 B1 4/2001 Rickerby
6,277,440 B1 8/2001 Reynolds
6,291,014 B1 9/2001 Warnes et al.
6,296,447 B1 10/2001 Rigney et al.
6,299,071 B1 10/2001 Maloney
6,299,971 B1 10/2001 Maloney
6,306,277 B1 10/2001 Strangman et al.
6,376,015 B1 4/2002 Rickerby
6,435,830 B1 8/2002 Allen et al.
6,455,167 B1 9/2002 Rigney et al.
6,458,473 B1 10/2002 Conner et al.
6,472,018 B1 10/2002 Warnes et al.

(Continued)

*Primary Examiner* — Erma Cameron
(74) *Attorney, Agent, or Firm* — Carlson, Gaskey & Olds, P.C.

(57) ABSTRACT

A coating method includes depositing substantially pure hafnium metal, that is free of other elements that are present in more than trace amounts as inadvertent impurities, onto a metallic substrate, and heat treating the metallic substrate to react the hafnium metal with at least one other element to form a protective coating on the metallic substrate.

11 Claims, 1 Drawing Sheet

(56) References Cited

U.S. PATENT DOCUMENTS

| | | | |
|---|---|---|---|
| 6,521,113 | B2 | 2/2003 | Strangman et al. |
| 6,610,419 | B1 | 8/2003 | Stamm |
| 6,645,926 | B2 | 11/2003 | Abriles et al. |
| 6,673,709 | B2 | 1/2004 | Jaslier et al. |
| 6,974,636 | B2 | 12/2005 | Darolia et al. |
| 7,214,409 | B1 * | 5/2007 | Kasule ..... 427/383.7 |
| 7,229,701 | B2 | 6/2007 | Madhava et al. |
| 7,357,958 | B2 | 4/2008 | Darolia et al. |
| 7,604,726 | B2 | 10/2009 | Kozlov et al. |
| 2002/0132132 | A1 | 9/2002 | Bose et al. |
| 2005/0079089 | A1 | 4/2005 | Narita et al. |
| 2010/0108524 | A1 | 5/2010 | van Mol et al. |

* cited by examiner

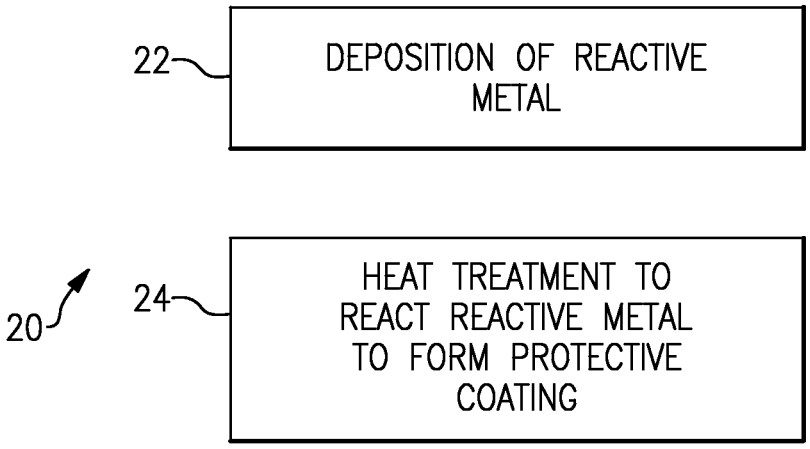
22
DEPOSITION OF REACTIVE METAL
20
24
HEAT TREATMENT TO REACT REACTIVE METAL TO FORM PROTECTIVE COATING

COATING METHOD FOR REACTIVE METAL

The present disclosure is a continuation of U.S. application Ser. No. 12/940,171, filed Nov. 5, 2010, now issued as U.S. Pat. No. 8,367,160.

BACKGROUND

This disclosure relates to forming protective coatings on articles, such as turbine engine components. Components that operate at high temperatures and under corrosive environments often include protective coatings. As an example, turbine engine components often include ceramic, aluminide, or other types of protective coatings. Chemical vapor deposition is one technique for forming the coating and involves pumping multiple reactive coating species into a chamber. The coating species react or decompose on the components in the chamber to produce the protective coating.

SUMMARY

A coating method according to an exemplary aspect of the present disclosure includes depositing substantially pure hafnium metal, that is free of other elements that are present in more than trace amounts as inadvertent impurities, onto a metallic substrate, and heat treating the metallic substrate to react the hafnium metal with at least one other element to form a protective coating on the metallic substrate.

In a further embodiment of any of the foregoing, the protective coating includes 10-2000 parts per million of the hafnium metal.

A further embodiment of any of the foregoing includes depositing platinum metal on the metallic substrate for reaction with the hafnium metal to form the protective coating.

A further embodiment of any of the foregoing includes depositing platinum metal on the hafnium metal, and then depositing additional hafnium metal on the platinum metal.

A further embodiment of any of the foregoing includes depositing platinum metal on the metallic substrate and then depositing the hafnium metal on the platinum metal.

A further embodiment of any of the foregoing includes aluminizing the metallic substrate after the heat treating.

In a further embodiment of any of the foregoing, the metallic substrate comprises a non-planar surface on which the protective coating is disposed.

In a further embodiment of any of the foregoing, the hafnium metal is present in the protective coating in an amount of 10-750 parts per million.

In a further embodiment of any of the foregoing, the hafnium metal is present in the protective coating in an amount of 10-500 parts per million.

BRIEF DESCRIPTION OF THE DRAWINGS

The various features and advantages of the disclosed examples will become apparent to those skilled in the art from the following detailed description. The drawings that accompany the detailed description can be briefly described as follows.

FIG. 1 illustrates an example coating method for depositing a reactive material.

DETAILED DESCRIPTION OF THE PREFERRED EMBODIMENT

FIG. 1 illustrates selected steps of an example coating method 20 that may be used to fabricate an article with a protective coating, such as a turbine engine component. A few example components are airfoils, vanes or vane doublets, blades, combustor panels, and compressor components. In the illustrated example, the coating method 20 generally includes deposition step 22 and heat treatment step 24. It is to be understood that the deposition step 22 and the heat treatment step 24 may be used in combination with other fabrication processes, techniques, or steps for the particular component that is being coated.

In general, the coating method 20 is used to deposit a reactive material, such as a metal or metalloid from the lanthanide group of elements, scandium metal, yttrium metal, hafnium metal, silicon, zirconium metal, or a combination of these elements. The reactive material may be a substantially pure metal or metalloid that is free of other elements that are present in more than trace amounts as inadvertent impurities. As will be described, the application of the heat treatment step 24 serves to react the metal or metalloid with at least one other element to form a protective coating on the subject component or substrate. In that regard, the other element may be an element from the underlying component, or an element from a neighboring metallic layer that is separately deposited onto the component.

As an example, a user may utilize an ionic liquid that is a melt of a salt to deposit the reactive material onto the component. Unlike electrolytic processes that utilize aqueous solutions to deposit or fabricate coatings, the disclosed coating method 20 utilizes a non-aqueous, ionic liquid for deposition of the reactive material. Thus, at least some metallic elements that cannot be deposited using aqueous techniques or chemical vapor deposition, may be deposited onto the subject component using the ionic fluid. The use of the ionic liquid also provides the ability to coat complex, non-planar surfaces, such as airfoils, with the reactive material.

Using hafnium metal as an example of the reactive material, the ionic liquid may be used to deposit a layer of the hafnium metal onto the surfaces of a subject component, such as a metallic substrate (e.g., superalloy substrate). It is to be understood that the examples herein based on hafnium may be applied to the other reactive material and are not limited to hafnium.

After deposition, the component may be subjected to the heat treatment step 24 at a suitable temperature and time for causing a reaction between the hafnium metal and at least one other element from the alloy of the metallic substrate. The temperature may be 1000°-2000° F. (approximately 538°-1093° C.), in a vacuum atmosphere, for a few hours. For instance, the hafnium may react with nickel or another element from the substrate to form a protective coating on the component.

In another example, after deposition of the hafnium metal and before the heat treatment step 24, a user deposits platinum metal onto the hafnium metal. That is, there are two separate and distinct layers of metals (a hafnium metal layer and a platinum metal layer). The heat treatment step 24 causes a reaction between the hafnium metal and the platinum metal, and possibly other elements from the alloy of the substrate, to form the protective coating.

In another similar example, a user deposits platinum metal directly onto the surfaces of the substrate component prior to the deposition of the hafnium metal. The user then deposits the hafnium metal onto the platinum metal. The heat treatment step 24 causes a reaction between the platinum metal and the hafnium metal, and possibly elements from the alloy of the substrate, to form a protective coating.

In another example, a user deposits the hafnium metal directly onto the substrate component and then platinum metal onto the hafnium metal. The user then deposits additional hafnium metal onto the platinum metal prior to the heat treatment step 24. The heat treatment step 24 causes a reaction between the two layers of hafnium metal and the platinum metal, and possibly elements from the underlying alloy of the substrate, to form the protective coating.

In any of the above examples, the component may additionally be aluminized after the heat treatment step 24 to interdiffuse aluminum metal into the protective coating and cause a reaction therewith to further alter the protective coating as desired. Optionally, in any of the above examples, the coating process may be controlled such that the amount of hafnium or other reactive material in the final protective coating is 10-2000 parts per million.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A coating method comprising:

depositing substantially pure hafnium metal, that is free of other elements that are present in more than trace amounts as inadvertent impurities, onto a metallic substrate to form a substantially pure hafnium metal layer on the metallic substrate; and heat treating the metallic substrate to react the hafnium metal with at least one other element to form a protective coating on the metallic substrate.

2. The coating method as recited in claim 1, wherein the protective coating includes 10-2000 parts per million of the hafnium metal.

3. The coating method as recited in claim 1, including depositing platinum metal on the metallic substrate for reaction with the hafnium metal to form the protective coating.

4. The coating method as recited in claim 1, further comprising depositing platinum metal on the metallic substrate and then depositing the hafnium metal on the platinum metal.

5. The coating method as recited in claim 1, further comprising aluminizing the metallic substrate after the heat treating.

6. The coating method as recited in claim 1, wherein the metallic substrate comprises a non-planar surface on which the protective coating is disposed.

7. The coating method as recited in claim 1, wherein the hafnium metal is present in the protective coating in an amount of 10-750 parts per million.

8. The coating method as recited in claim 1, wherein the hafnium metal is present in the protective coating in an amount of 10-500 parts per million.

9. The coating method as recited in claim 1, wherein the metallic substrate is a superalloy gas turbine engine component, and the hafnium metal is deposited directly on to a surface of the superalloy gas turbine engine component.

10. The coating method as recited in claim 9, wherein the at least one other element is from the metallic substrate.

11. The coating method as recited in claim 9, wherein the at least one other element is nickel from the metallic substrate.

* * * * *